US005539278A

United States Patent [19]

Takahashi

[11] Patent Number: 5,539,278

[45] Date of Patent: Jul. 23, 1996

[54] COLOR CATHODE RAY TUBE

[75] Inventor: Yoshiaki Takahashi, Chiba, Japan

[73] Assignee: Hitachi, Ltd., Tokyo, Japan

[21] Appl. No.: 341,194

[22] Filed: Dec. 5, 1994

[30] Foreign Application Priority Data

Dec. 7, 1993 [JP] Japan ..... 5-306255

[51] Int. Cl.[6] ..... H01J 29/46; H01J 29/56

[52] U.S. Cl. ..... 315/14; 315/15; 315/382.1; 313/414

[58] Field of Search ..... 315/14, 15, 382, 315/382.1; 313/414, 449

[56] References Cited

U.S. PATENT DOCUMENTS

| | | | |
|---|---|---|---|
| Re. 34,339 | 8/1993 | Osakabe | 315/382 |
| 4,877,998 | 10/1989 | Maninger et al. | 315/15 |
| 4,886,999 | 12/1989 | Yamane et al. | 313/414 |
| 5,077,497 | 12/1991 | Kamohara et al. | 313/414 |
| 5,212,423 | 5/1993 | Noguchi et al. | 313/414 |

*Primary Examiner*—Theodore M. Blum
*Attorney, Agent, or Firm*—Antonelli, Terry, Stout & Kraus

[57] ABSTRACT

A color cathode ray tube includes three in-line cathodes, a control electrode, an accelerating electrode, a first focusing electrode member, a second focusing electrode member, an anode, and a phosphor surface disposed in the order listed after the three in-line cathodes along a tube axis, and a fixed resistor disposed inside the color cathode ray tube. The fixed resistor is coupled between the anode and ground, and has a focusing power supply terminal. The three in-line cathodes emit respective electron beams which pass through the control electrode, the accelerating electrode, the first focusing electrode member, the second focusing electrode member, and the anode and land on the phosphor surface. The first focusing electrode member receives a constant focusing voltage from the focusing power supply terminal of the fixed resistor, and the second focusing electrode member receives a dynamic focusing voltage which varies in accordance with a deflection angle of the electron beams. A quadrupole lens is formed between the first focusing electrode member and the second focusing electrode member by the constant focusing voltage received by the first focusing electrode member and the dynamic focusing voltage received by the second focusing electrode member. The quadrupole lens converges each of the electron beams in a first direction and diverges each of the electron beams in a second direction perpendicular to the first direction, and has an intensity which varies in accordance with the dynamic focusing voltage, thereby varying in accordance with the deflection angle of the electron beams.

8 Claims, 10 Drawing Sheets

COLOR CATHODE RAY TUBE

BACKGROUND OF THE INVENTION

1. Field of the Invention

The present invention relates to a color cathode ray tube, and more specifically to an electron gun for a color cathode ray tube with an improved resolution over its entire phosphor screen.

2. Description of the Prior Art

FIG. 10 is a cross-sectional view of a shadow mask type color cathode ray tube, showing the structure of the color cathode ray tube of this kind. Designated 31 is a panel portion, 32 a neck portion, 33 a funnel portion, 34 a phosphor screen, 35 a shadow mask, 36 a mask frame, 37 a magnetic shield, 38 a suspension spring, 39 an electron gun, 40 a deflection yoke, 41 a correction magnetic device, 42 an inner conductive film, and 43 a high-voltage terminal.

In the color cathode ray tube shown in the figure, a vacuum enclosure is formed by the panel portion 31 having the phosphor screen 34 on its inner side, and by the neck portion 32 connected to the side-wall skirt portion of the panel portion 31 through the funnel portion 33. The neck portion 32 incorporates the electron gun 39.

The shadow mask 35 is fixedly supported on the mask frame 36 and is suspended by the suspension spring 38 on the inner side of the panel portion 31 so that the shadow mask 35 is close to the phosphor screen 34. The mask frame 36 is provided with a magnetic shield 37 for protection against external magnet fields.

Mounted over a transition area between the funnel portion 33 and the neck portion 32 is the deflection yoke 40 that deflects three electron beams Bc (a center beam) and Bs (two side beams) emitted from the electron gun 39 in horizontal and vertical directions. The deflected electron beams Bc, Bs then pass through the shadow mask 35 and land on the phosphor screen 34.

The phosphor screen 34 has a mosaic pattern of red, green and blue phosphor groups, each phosphor taking the form of a stripe or dot.

The shadow mask 35 is an electrode with a large number of apertures arranged so as to allow the three electron beams Bc, Bs to pass therethrough and precisely strike each of the three-color phosphor groups making up the phosphor screen 34, thereby performing a so-called color selection.

The funnel portion 33 has its inner wall coated uniformly with the inner conductive film 42 that extends to a part of the inner wall of the neck portion 32, and a high voltage is applied from the high-voltage terminal 43 piercing through the funnel portion. The funnel portion 33 is also coated with a conductive film on its outer wall.

The electron gun 39 includes a cathode of an electron beam generating section that produces, accelerates and controls three in-line parallel electron beams; a prefocusing section to control the electron beams; and a main lens section to converge the electron beams onto the phosphor screen 34.

FIG. 11 shows a distribution pattern of a magnetic deflection field generated by the deflection yoke. As shown in the figure, a horizontal deflection field 60 has a pincushion-like distortion and a vertical deflection field 61 a barrel-like distortion.

FIG. 12(*a*) and 12(*b*) show how the deflection field acts on an electron beam. A deflected scanning electron beam 62 in the periphery of the phosphor screen 34 receives not only a deflection force 63 as shown in FIG. 12(*a*) but also a horizontal diverging force 64 and a vertical converging force 65 as shown in FIG. 12(*b*), with the result that the beam spot on the phosphor screen 34 is deformed.

FIG. 13 shows the spot shapes of the electron beams landing on the phosphor screen. A central beam 62' on the phosphor screen 34 is circular, whereas electron beams 62" formed at the periphery of the phosphor screen 34 are deformed into non-circular shapes consisting of a high-luminance core portion 62"H and a low-luminance halo portion 62"L. A large vertical elongation of the halo portion 62"L in particular has adverse effects on the focusing characteristic. To reduce such degradation of the focusing characteristic, the conventional electron gun employs, for example, a construction disclosed in Japanese Patent Laid-Open No. 62-58549, in which a dynamic focusing voltage is applied to an electrostatic quadrupole lens.

SUMMARY OF THE INVENTION

The above-mentioned conventional technique, however, requires two systems of power supply-one for a constant focusing voltage and the other for a dynamic focusing voltage that changes according to the amount of deflection angle-for the flyback transformer, complicating the power supply circuit configuration and increasing cost.

An objective of this invention is to overcome the above-mentioned drawback experienced with the conventional technique and to provide a color cathode ray tube which uses a flyback transformer that supplies only a dynamic focusing voltage, thereby simplifying the power supply circuit and improving the focusing performance.

To achieve the above objective, the electron gun of this invention includes three in-line cathodes emitting electron beams; and a control electrode, an accelerating electrode, a focusing electrode and an anode, all having at least three in-line openings facing the cathodes, all these electrodes and the three in-line cathodes being arranged along the tube axis. This electron gun is configured as follows. The focusing electrode is divided along the tube axis into a first focusing electrode member and a second focusing electrode member. A quadrupole lens is formed between the first and second focusing electrode members which causes the electron beams to converge in one direction and diverge in another direction perpendicular to the first direction. The second focusing electrode member situated on the anode side receives a dynamic focusing voltage that changes according to the amount of electron beam deflection. The first focusing electrode member located on the cathode side receives a constant-value focusing voltage through a variable voltage circuit connected between the anode and ground to change the intensity of the quadrupole lens according to the electron beam deflection. The variable voltage circuit is formed by a series circuit made up of a fixed resistor having a power supply terminal for the first focusing electrode member and a variable resistor or a DC power supply inserted between the fixed resistor and ground. This configuration permits the electron gun to have only one focusing power supply system.

When this invention is applied to a so-called multistage focusing electron gun-which has a control electrode, a first accelerating electrode, a front-stage focusing electrode, a second accelerating electrode, a first rear-stage focusing electrode member, a second rear-stage focusing electrode member and an anode-there may be a case where a so-called knocking process cannot effectively be applied to the control electrode and the first accelerating electrode, resulting in a poor withstand voltage performance withstand characteristic. The electron gun of this invention has a specified constant focusing voltage applied to the first rear-stage focusing electrode member and a dynamic focusing voltage applied to the front-stage focusing electrode and the second rear-stage focusing electrode member. This configuration effectively applies the knocking process to the electrodes close to the cathode, such as the control electrode and the first accelerating electrode.

BRIEF DESCRIPTION OF THE DRAWINGS

FIG. 8(*b*) is a front view of the second focusing electrode member as viewed from the anode side along the line VIII(b)—VIII(b) in FIG. 7;

FIG. 8(*c*) is a front view of the first focusing electrode member as viewed from the anode side along the line VIII(c)—VIII(c) in FIG. 7;

DESCRIPTION OF THE PREFERRED EMBODIMENTS

First Embodiment

A constant focusing voltage (static focusing voltage) can be supplied to a first focusing electrode member from an anode by dividing a voltage applied to the anode through a resistor. Thus, only a dynamic focusing voltage is supplied from a flyback transformer, which therefore requires only one power supply system.

The dynamic focusing voltage is supplied from the flyback transformer through a capacitor as a voltage of several hundred volts, thus providing the identical function as a two flyback transformer system.

Now, one embodiment of this invention will be described in detail by referring to the accompanying drawings.

Figure 1:
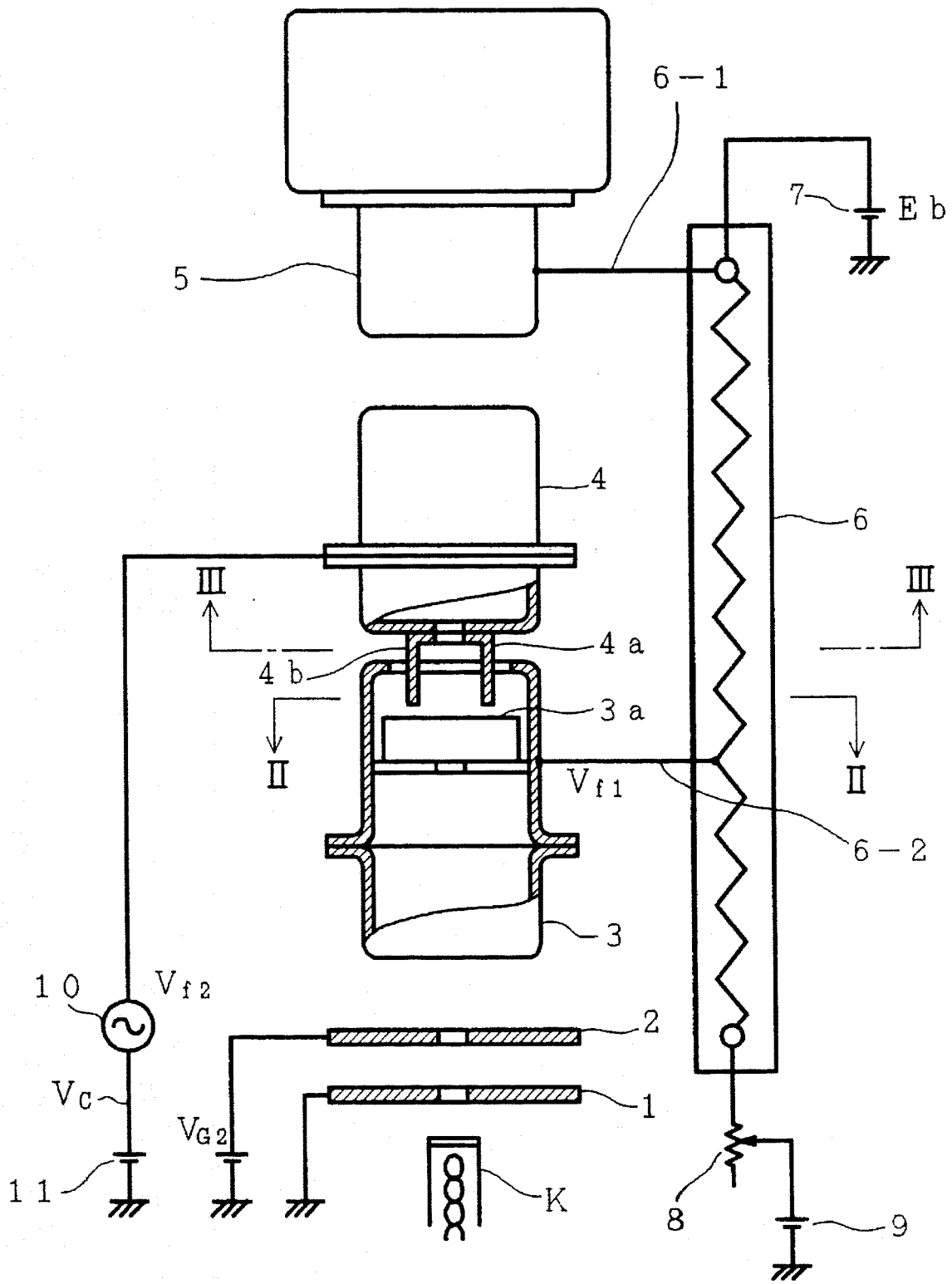
FIG. 1 is a schematic side-cross section, as viewed from the in-line direction, of one embodiment of an electron gun used in a color cathode ray tube of this invention.

FIG. 1 shows one embodiment of the electron gun used in the color cathode ray tube of this invention. FIG. 1 is a schematic side cross section as seen from the in-line direction. Reference symbol K represents a hot cathode (hereinafter referred to simply as a cathode), 1 a control electrode, 2 an accelerating electrode, 3 a first focusing electrode member, 4 a second focusing electrode member, 5 an anode, 6 a fixed resistor, 6-1 an anode power supply terminal, 6-2 a focusing power supply terminal, 7 a high-voltage power supply (Eb), 8 a variable resistor, 9 a DC power supply, 10 a dynamic focusing power supply, 11 a bias power supply, $Vf_1$ a constant focusing voltage, and $Vf_2$ a dynamic focusing voltage.

Denoted 3*a* is a vertical flat electrode disposed on the first focusing electrode member 3 on the side of the second focusing electrode member 4. Designated 4*a* and 4*b* are horizontal flat electrodes disposed on the second focusing electrode member 4 on the side of the first focusing electrode member 3.

In FIG. 1, the cathode K, the control electrode 1 and the accelerating electrode 2 form a triode section; the first focusing electrode member 3 and the second focusing electrode member 4 form a quadrupole lens; and the second focusing electrode member 4 and the anode 5 form a main lens between them.

Figure 2:
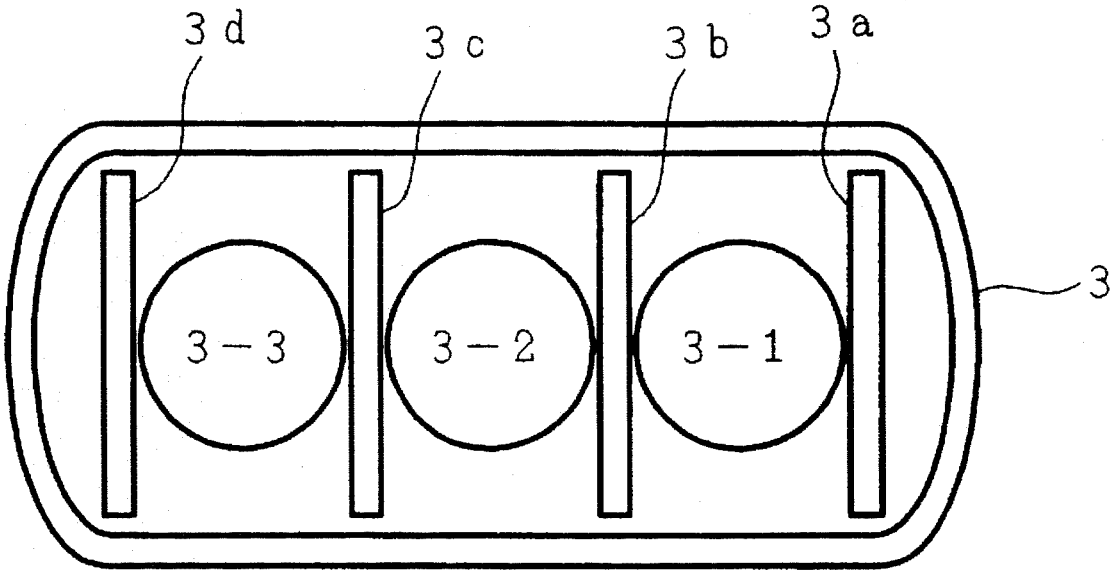
FIG. 2 is a front view of a first focusing electrode member, as viewed along the line II—II in FIG. 1.
Figure 3:
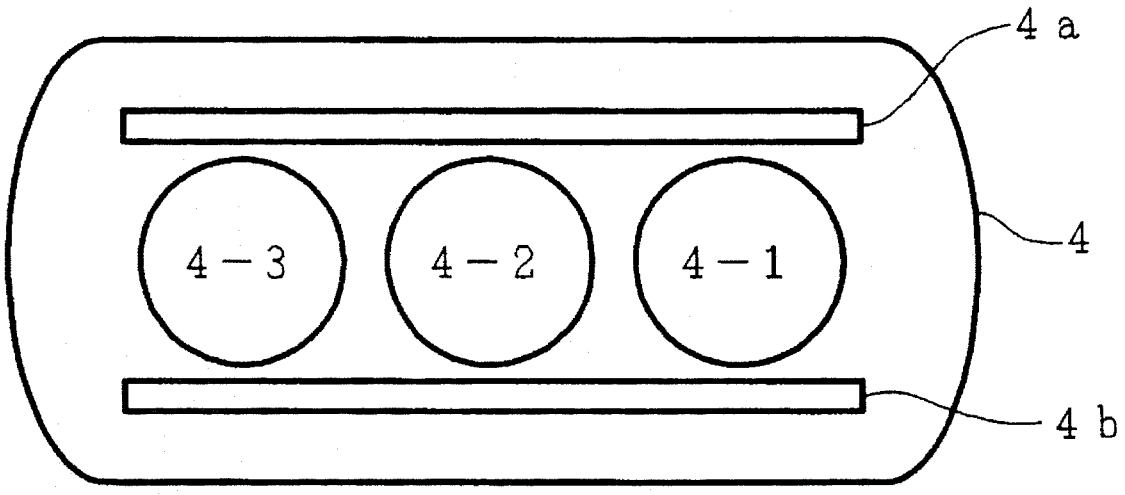
FIG. 3 is a front view of a second focusing electrode member, as viewed along the line III—III in FIG. 1.

FIG. 2 is a front view of the first focusing electrode member 3 as seen along the line II—II in FIG. 1. FIG. 3 is a front view of the second focusing electrode member 4 as seen along the line III—III in FIG. 1. Designated 3-1, 3-2 and 3-3 are apertures formed in the first focusing electrode member 3; 3*a*, 3*b*, 3*c* and 3*d* are vertical flat electrodes; 4-1, 4-2 and 4-3 are apertures formed in the second focusing electrode member 4; and 4*a* and 4*b* are horizontal flat electrodes.

The front sides of the first focusing electrode member 3 and the second focusing electrode member 4 shown in FIGS. 2 and 3 are arranged opposing each other as shown in FIG. 1 to form a quadrupole lens between the first and second focusing electrode members 3, 4 that elongates the electron beam vertically.

Figure 4:
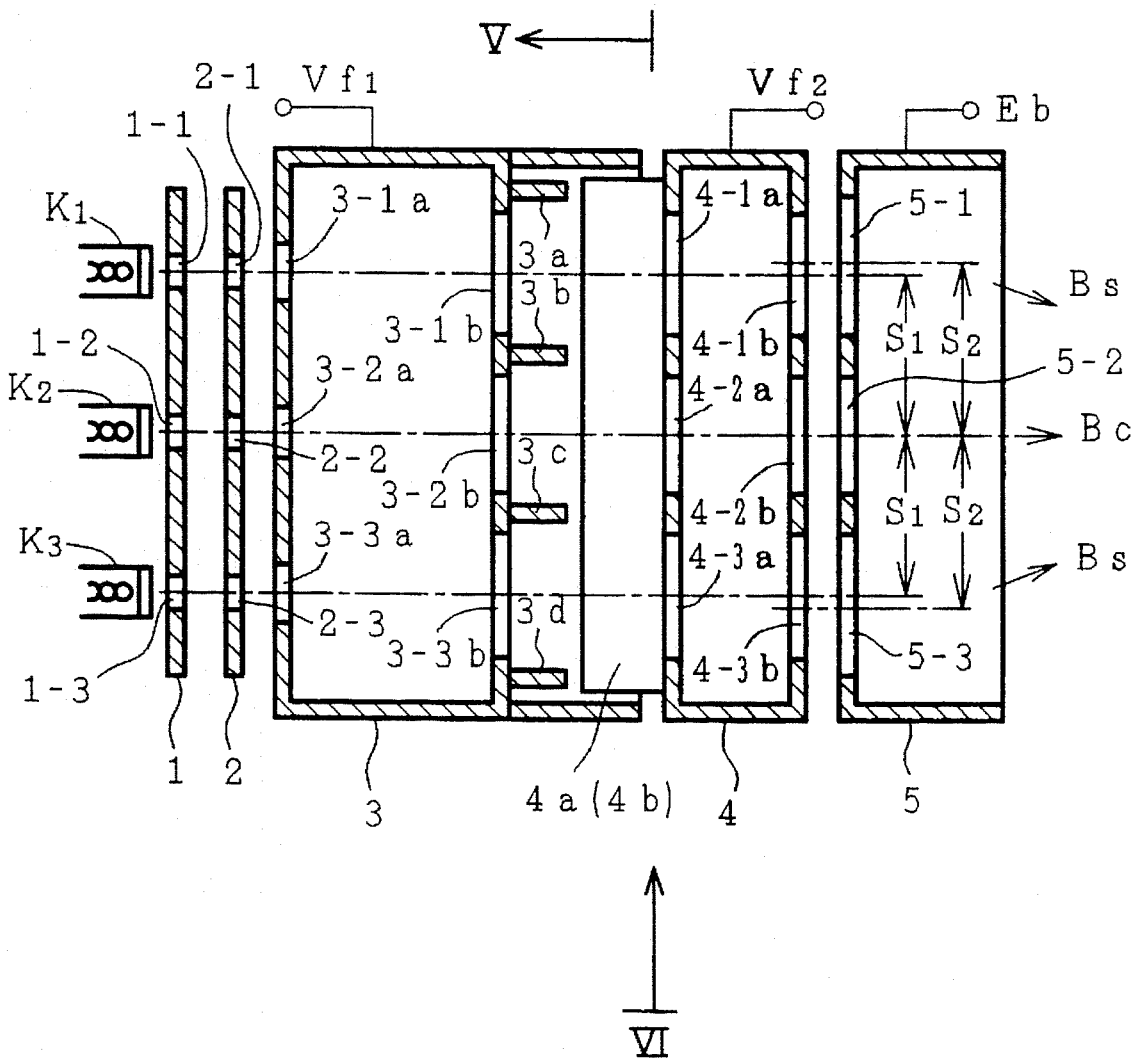
FIG. 4 is a cross section of the electron gun of FIG. 1 as viewed from a direction perpendicular to the in-line direction.

FIG. 4 is a schematic cross section of the electron gun of FIG. 1 as seen from a direction perpendicular to the in-line direction. Reference symbols $K_1$, $K_2$ and $K_3$ represent cathodes; 1 a control electrode; 2 an accelerating electrode; 3 a first focusing electrode member; 4 a second focusing electrode member; 5 an anode; 1-1 to 1-3 apertures formed in the control electrode 1; 2-1 to 2-3 apertures formed in the accelerating electrode 2; and 3-1*a* to 3-3*a* apertures formed in the first focusing electrode member 3 on the side of the accelerating electrode 2. Denoted 3-1*b* to 3-3*b* are apertures formed in the first focusing electrode member 3 on the side of the second focusing electrode member 4. Designated 4-1*a* to 4-3*a* are apertures formed in the second focusing electrode member 4 on the side of the first focusing electrode member 3; 4-1*b* to 4-3*b* apertures formed in the second focusing electrode member 4 on the side of the anode 5; and 5-1 to 5-3 apertures formed in the anode 5. Vertical flat electrodes 3*a*, 3*b*, 3*c* and 3*d* are disposed on the first focusing electrode member 3 on the side of the second focusing electrode member 4 in such a way as to sandwich each of the apertures 3-1*b* to 3-3*b* in the in-line direction. Horizontal flat electrodes 4*a* and 4*b* are disposed on the second focusing electrode member 4 on the side of the first focusing electrode member 3 in such a way as to sandwich the apertures 4-1*a* to 4-3*a* in a direction perpendicular to the in-line direction.

Symbol $S_1$ represents a distance between the axes of the center beam Bc and the side beams Bs; and $S_2$ represents a distance between the axes of the side apertures 5-1, 5-3 and the axis of the center aperture 5-2.

In operation, the anode 5 is at a high voltage (Eb); the accelerating electrode 2 is at a low voltage $VG_2$; the first focusing electrode member 3 is at a constant focusing voltage $Vf_1$ (static focusing voltage); and the second focusing electrode member 4 is at a dynamic focusing voltage, $Vf_2$, which may become higher than the voltage $Vf_1$ at the first focusing electrode member 3 depending on the deflection angle of the electron beam.

With the color cathode ray tube constructed in this way, when the horizontal deflection angle is zero, i.e., when the first focusing electrode member 3 and the second focusing electrode member 4 are at the same potential, the quadrupole lens is not formed between the vertical flat electrodes 3*a*, 3*b*, 3*c*, 3*d* and the horizontal flat electrodes 4*a*, 4*b* of the first and the second focusing electrode members 3 and 4. Hence, the three electron beams Bc, Bs are focused at the central portion of the phosphor screen by the main lens formed between the second focusing electrode member 4 and the anode 5.

As the horizontal deflection angle increases, the potential of the second focusing electrode member 4 becomes higher than that of the first focusing electrode member 3, thus forming the quadrupole lens-which elongates the electron beam vertically-between the vertical flat electrodes 3*a*, 3*b*, 3*c*, 3*d* of the first focusing electrode member 3 and the horizontal flat electrodes 4*a*, 4*b* of the second focusing electrode member 4. At the same time, the potential difference between the second focusing electrode member 4 and the anode 5 becomes small, mitigating the action of the main lens.

Figure 5:
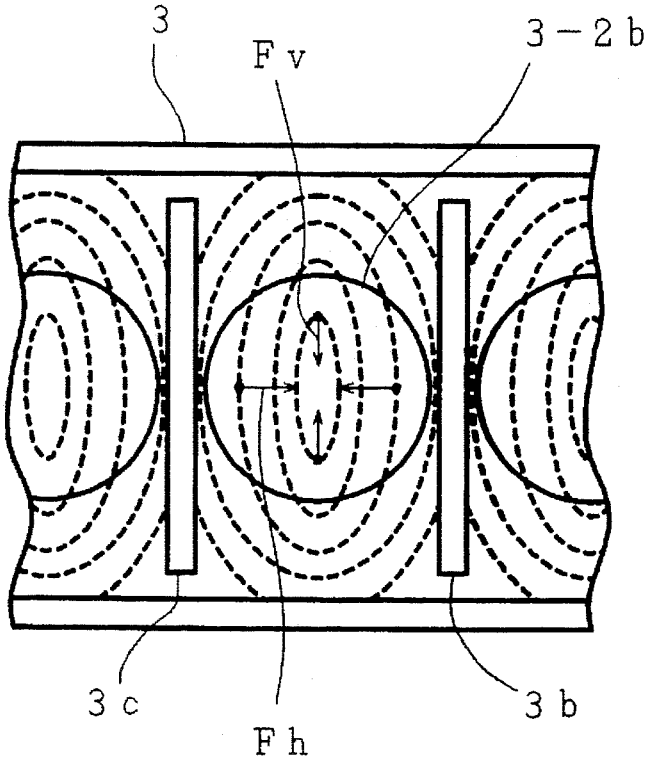
FIG. 5 is a schematic diagram showing the action of the quadrupole lens as viewed along the line V in FIG. 4.
Figure 6:
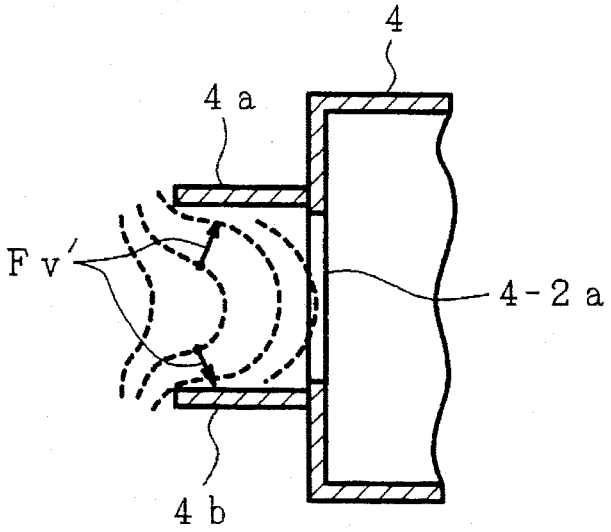
FIG. 6 is a schematic diagram showing the action of the quadrupole lens as viewed along the line VI in FIG. 4.

FIG. 5 shows the action of the quadrupole lens as seen along the line V in FIG. 4. FIG. 6 shows the same as seen along the line VI in FIG. 4.

By referring to FIG. 5 and 6, it will be explained how the quadrupole lens that elongates the electron beam vertically is formed between the first focusing electrode member 3 and the second focusing electrode member 4.

In FIG. 5, if a potential $V_1$ applied to the vertical flat electrodes 3*b*, 3*c* located on both sides of the center aperture 3-2*b* and a potential $V_2$ applied to the horizontal flat electrodes 4*a*, 4*b* located on the top and bottom sides of the center aperture 4-2*a* have the relationship of $V_1 < V_2$, then the equipotential lines of the quadrupole lens and its force lines acting on the electron beam-which passes through the aperture 3-2*b*-are dense in the horizontal direction and sparse in the vertical direction. If the force acting on the electron beam in the vertical direction is expressed as Fv and the force acting in the horizontal direction is expressed as Fh, the action of the quadrupole lens can be represented by Fv< Fh, making the electron beam vertically elongated.

The shape of the electron beam as produced by the horizontal flat electrodes 4*a*, 4*b* disposed on the second focusing electrode member 4 is vertically elongated because the beam is subjected to the vertically dense lines of force of the quadrupole lens, i.e., a divergent force Fv' in the vertical direction.

Figure 10:
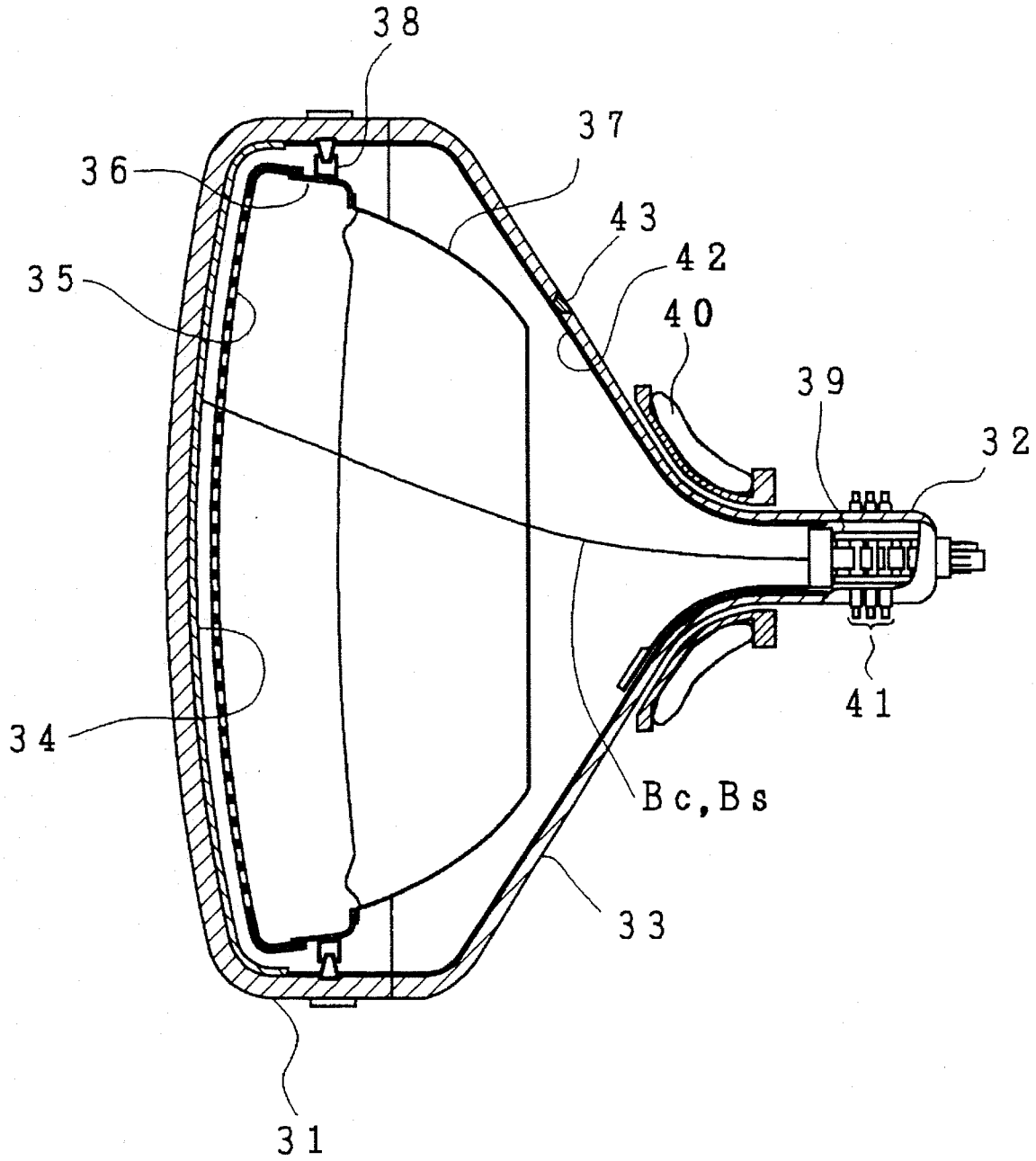
FIG. 10 is a cross section of a shadow mask type color cathode ray tube showing the structure of the color cathode ray tube.
Figure 11:
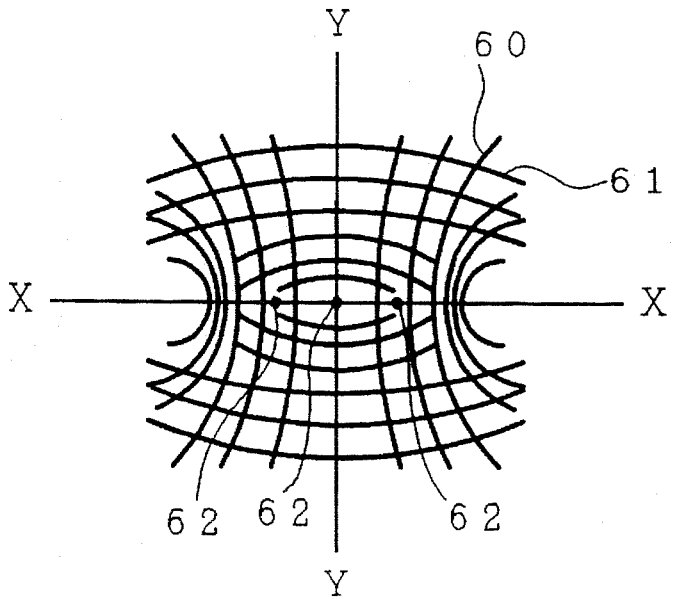
FIG. 11 is a schematic diagram showing the distribution pattern of a magnetic deflection field generated by the deflection yoke.
Figure 12:
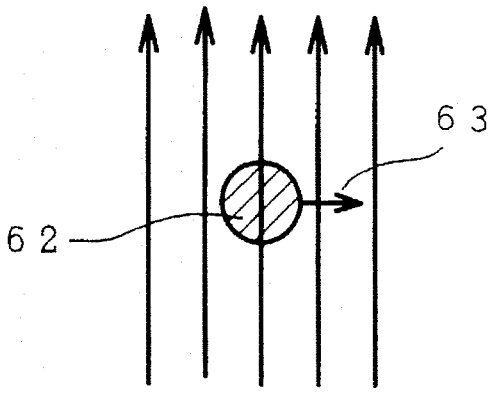
FIGS. 12(*a*) and 12(*b*) show how the deflection field acts on the electron beam, with FIG. 12(*a*) showing the deflection action of the deflection field on the electron beam and FIG. 12(*b*) illustrating the diverging action and the converging action of the deflection field on the electron beam.
Figure 12:
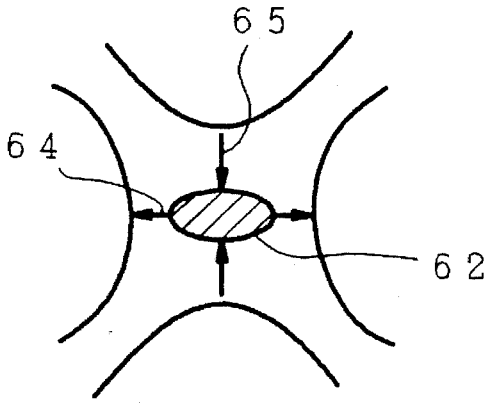
Figure 13:
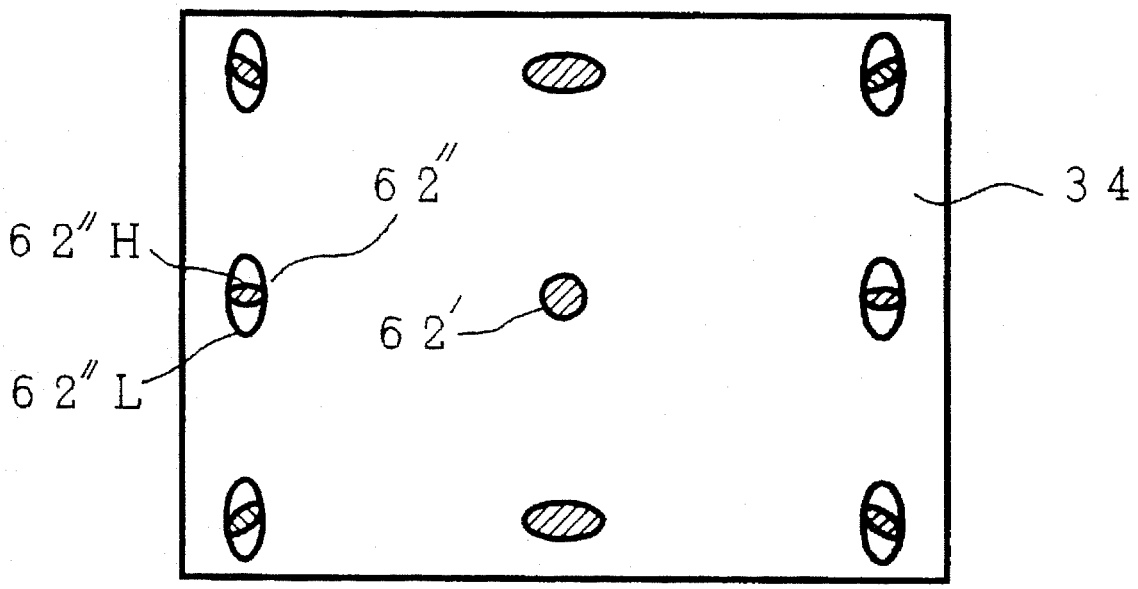
FIG. 13 is a schematic diagram showing electron beam spots that land on the phosphor screen.

The force generated between the vertical flat electrodes 3*b*, 3*c* and the horizontal flat electrodes 4*a*, 4*b* diverges the electron beam in the vertical direction and converges it in the horizontal direction, canceling the tendency of the electron beam to be horizontally flattened by the magnetic deflection field generated by the deflection yoke 40 in FIG. 10.

Further, because the focusing action of the main lens formed between the second focusing electrode member 4 and the anode 5 is mitigated as the deflection angle increases, it is also possible to eliminate overfocusing caused by the electron beam deflection.

In FIG. 1, the cathode K receives a voltage of, for example, about 100 V and a modulation signal corresponding to an image. The control electrode 1 is grounded and the accelerating electrode 2 receives a low voltage $VG_2$ of around 400–600 V.

The second focusing electrode member 4 receives an intermediate voltage (static focusing voltage) of Vc=4–7 kV from the DC power supply 11 on which in synchronism with the deflection of the electron beam, is superimposed the dynamic focusing voltage Vf2 of from 0 V to 200–500 V.

The anode 5 receives a final acceleration voltage Eb of about 25–30 kV from the high-voltage power supply 7 through the anode power supply terminal 6-1.

The first focusing electrode member 3 receives the constant focusing voltage $Vf_1$, which is a specified intermediate voltage taken from the focusing power supply terminal 6-2 attached to the intermediate position of the fixed resistor 6 which is connected at one end to the anode 5 and at the other end to a series circuit consisting of the variable resistor 8 and the DC power supply 9. The constant focusing voltage $Vf_1$ can be adjusted by the variable resistor 8.

With this embodiment, because the constant focusing voltage to be supplied to the electron gun can be obtained from the power supply system that supplies the anode 5, the flyback transformer needs only one power supply system that supplies the dynamic focusing voltage. This simplifies the power supply system from the flyback transformer, lowering the cost.

Second Embodiment

In another embodiment of this invention, a front-stage focusing electrode is connected to a second rear-stage focusing electrode member allowing a knocking process to be performed effectively, improving a voltage withstand characteristic and a focusing characteristic.

Figure 7:
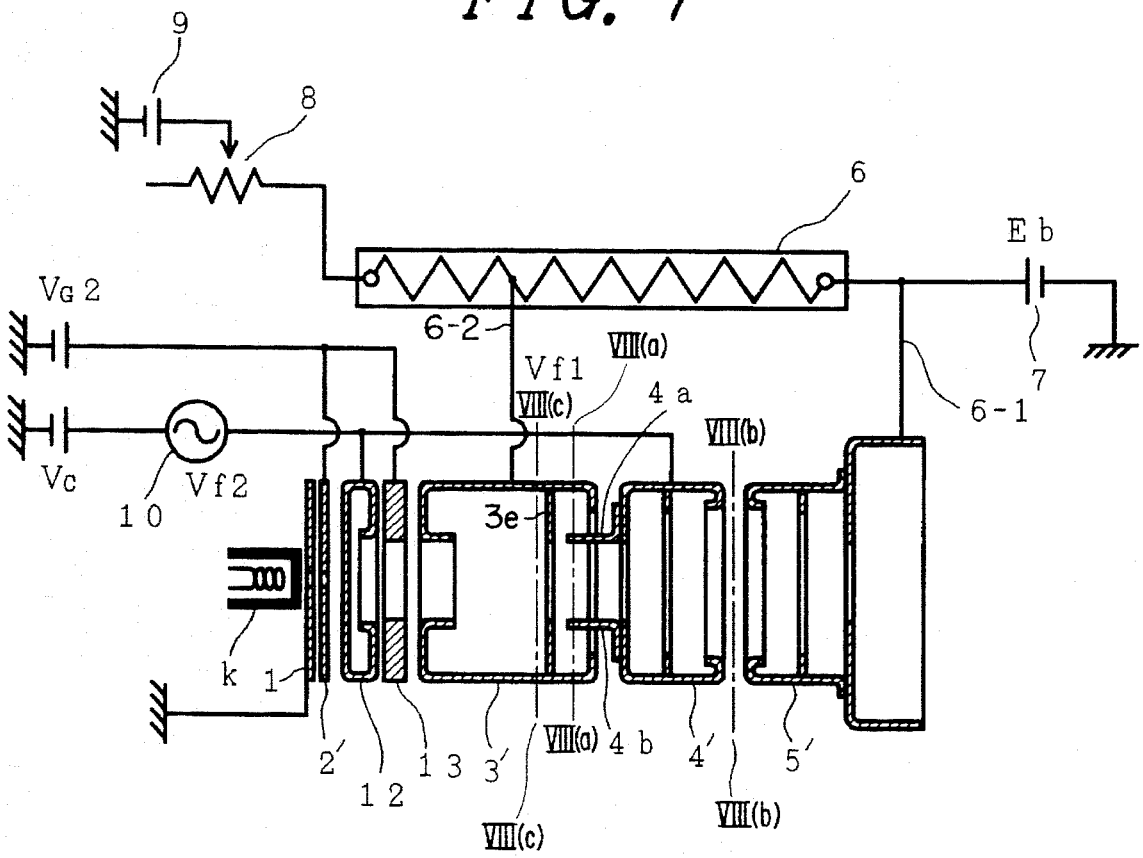
FIG. 7 is a schematic cross section of another embodiment of an electron gun used in a color cathode ray tube of this invention.

FIG. 7 shows a schematic side-cross section, as viewed from the in-line direction, of another embodiment of the electron gun used in the color cathode ray tube of this invention. Components identical with those of FIG. 1 are assigned like reference numerals. Reference symbol K represents a cathode, 1 a control electrode (G1 electrode), 2' a first accelerating electrode (G2 electrode), 12 a front-stage focusing electrode (G3 electrode), 13 a second accelerating electrode (G4 electrode), 3' a first rear-stage focusing electrode member (G5-1 electrode), 4' a second rear-stage focusing electrode member (G5-2 electrode), 5' an anode (G6 electrode), 6 a fixed resistor, 6-1 an anode power supply terminal, 6-2 a focusing power supply terminal, 7 a high-voltage power supply (Eb), 8 a variable resistor, 9 a DC power supply, 10 a dynamic focusing power supply, 11 a bias power supply, $Vf_1$ a constant focusing voltage, and $Vf_2$ a dynamic focusing voltage.

Figure 8:
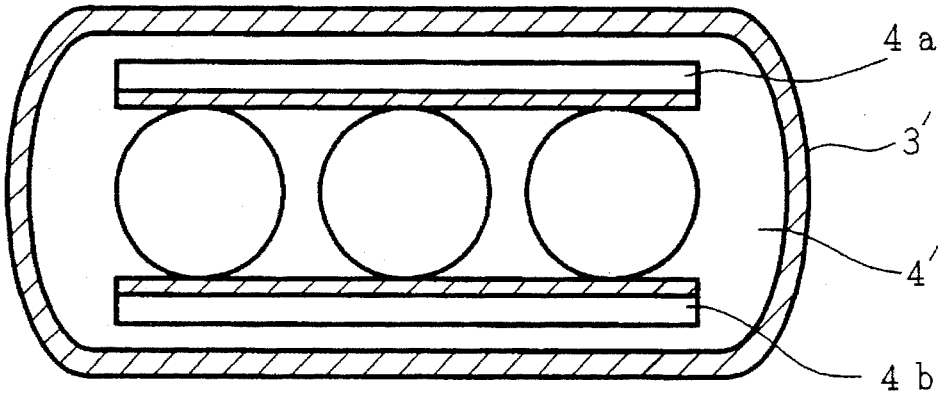
FIG. 8(*a*) is a front view of the focusing electrode member as viewed from the cathode side along the line VIII(a)—VIII(a) in FIG. 7.
Figure 8:
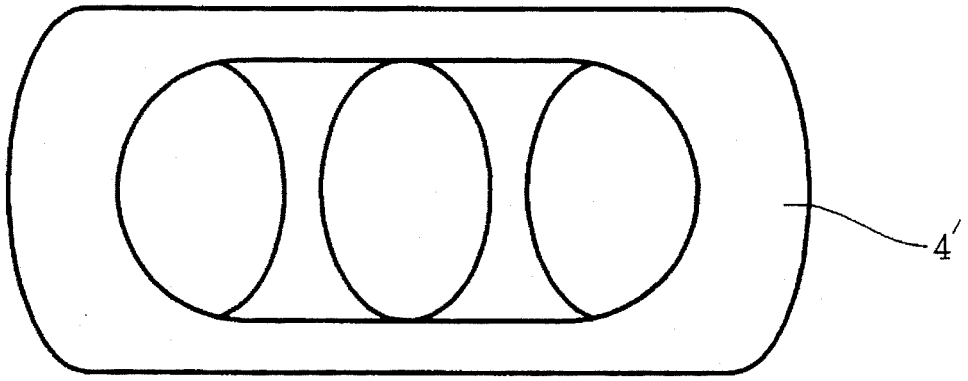
Figure 8:
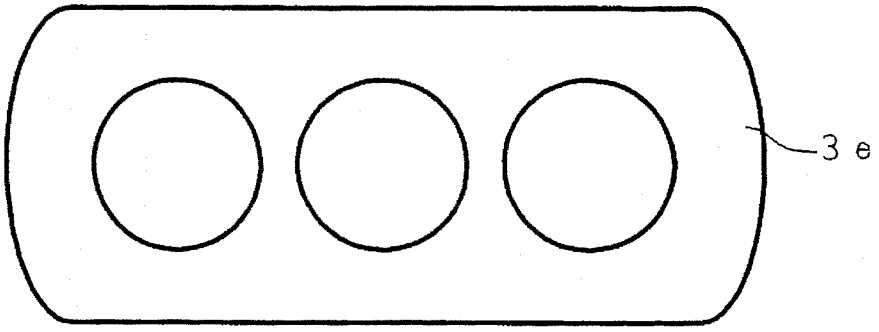

FIG. 8(*a*) is a front view of the first rear-stage focusing electrode member 31 as seen from the cathode side along the line VIII(a)—VIII(a) in FIG. 7. FIG. 8(*b*) is a front view of the second rear-stage focusing electrode member 4' as seen from the anode side along the line VIII(b)—VIII(b) in FIG. 7. FIG. 8(*c*) is a front view of the first rear-stage focusing electrode member 3' as seen from the cathode side along the line VIII(c)—VIII(c) in FIG. 7. Denoted 3*e* is an electrode plate disposed inside the G5-1 electrode 3'. Designated 4*a* and 4*b* are horizontal flat electrodes disposed on the G5-2 electrode 4' on the side of the G5-1 electrode 3'. To the electrode 5' is applied an anode voltage Eb from the high-voltage power supply 7 through a shield cup. The anode voltage Eb is also applied to one end of the fixed resistor 6. The other end of the fixed resistor 6 is grounded through the variable resistor 8 and the DC power supply 9 outside an enclosure.

A specified constant focusing voltage $Vf_1$ is applied to the G5-1 electrode 3' from the focusing power supply terminal 6-2 connected to an intermediate position in the fixed resistor 6.

The G5-2 electrode 4' and the G3 electrode 12 receive a constant focusing voltage Vc on which is superimposed the dynamic focusing voltage $Vf_2$. By increasing $Vf_2$ according to an increase in the deflection of the electron beam, it is possible to perform dynamic astigmatism correction and dynamic focusing at the same time, so that the flyback transformer need only supply the dynamic focusing voltage. Therefore, the flyback transformer requires only one power supply system.

Further, in the process of manufacturing the cathode ray tube, a knocking process is performed after assembly to improve a voltage withstand characteristic. One objective of the knocking process is to cause an electric discharge from an electrode situated above the G2 and G1 electrodes and thereby remove foreign matter and small projections on the G2 and G1 electrodes, improving the voltage withstand characteristic.

Figure 9:
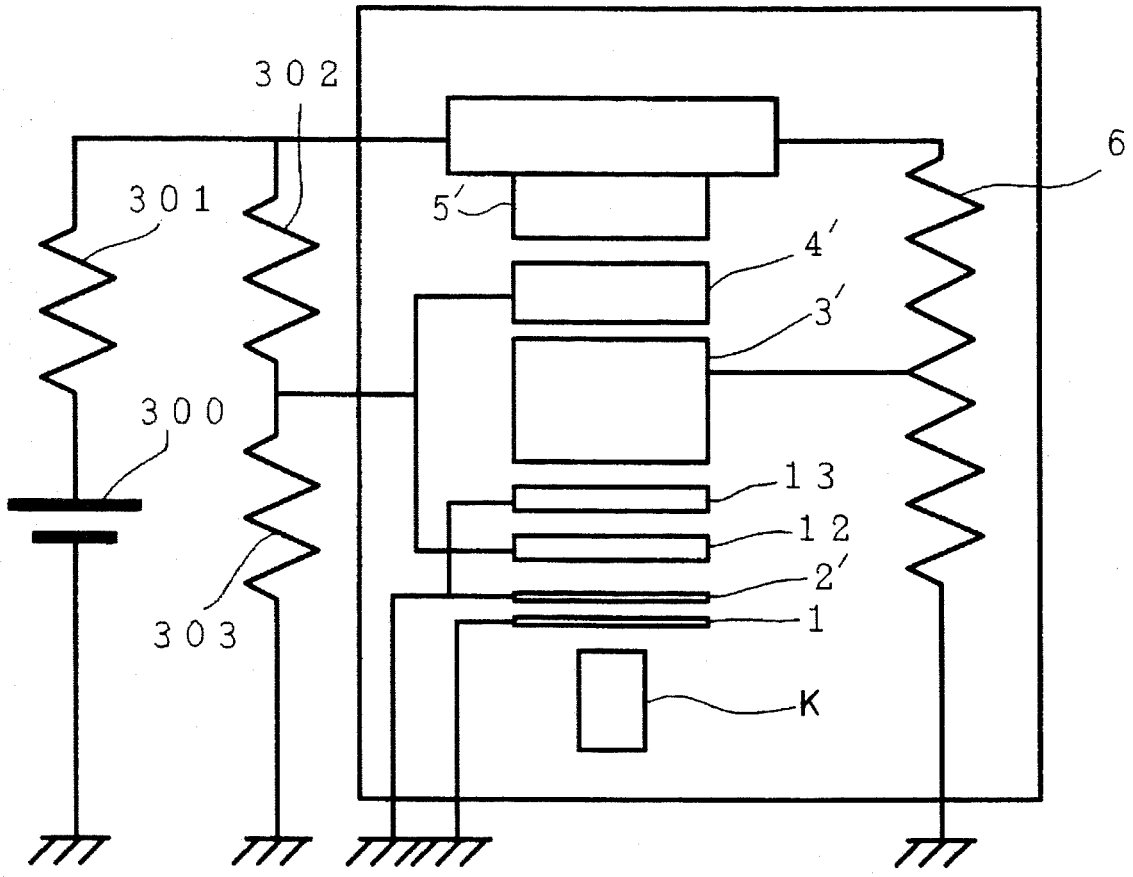
FIG. 9 is a circuit configuration for the process of knocking the electron gun used in the color cathode ray tube of this invention.

For a multi-stage focusing type electron gun, such as that used in the color cathode ray tube of this invention shown in FIG. 7, a knocking process circuit as shown in FIG. 9 is used. That is, the G6 electrode 5' of the assembled cathode ray tube receives a knocking voltage higher than a normally used voltage from a power supply 300 via a resistor 301. The knocking voltage is divided by resistors 302, 303 provided outside the cathode ray tube and the divided voltage is then applied to the G5-2 electrode 4' and the G3 electrode 12. When an electric discharge occurs between the G6 electrode 5' and the G5-2 electrode 4', the voltages of the G5-2 electrode 4' and the G3 electrode 12 instantaneously rise. The instant increase in the voltage of the G3 electrode 12 in turn causes an electric discharge between the G3 electrode 12, the G2 electrode 2' and the G1 electrode 1.

In the embodiment shown in FIG. 7, the knocking process is effective because the G3 electrode 12 and the G5-2 electrode 4' are connected to one another.

Further, because the static focusing voltage Vc on which is superimposed the dynamic focusing voltage $Vf_2$ is applied to the G3 electrode 12, the intensities of unipotential type lenses between the G3 electrode 12, the G4 electrode 13 and the G5-1 electrode 3' dynamically change. That is, the voltage at the G3 electrode becomes higher at the periphery of the screen than at the center and thus the lens intensity is stronger at the periphery, making the electron beam focusing action stronger and the electron beam diameter relatively small at the periphery of the screen. This means that at the central area of the screen the beam spot diameter is further reduced compared with that obtained with the conventional technique, and, at the screen periphery, there are reduced astigmatism effects, making the astigmatism correction easier.

As described above, with this invention, the color cathode ray tube having a quadrupole lens using dynamic voltage needs only one focusing voltage (a dynamic focusing voltage) from the flyback transformer. Further, when this invention is applied to a multi-stage focusing electron gun, it is possible to provide an excellent color cathode ray tube, in which knocking processing effectively improves the voltage withstand characteristic of the electron gun and the focusing characteristic is improved.

What is claimed is:

1. A color cathode ray tube comprising:

three in-line cathodes;

a control electrode having at least three in-line apertures disposed after the three in-line cathodes along a tube axis of the color cathode ray tube;

an accelerating electrode having at least three in-line apertures disposed after the control electrode along the tube axis;

a first focusing electrode member having at least three in-line apertures disposed after the accelerating electrode along the tube axis;

a second focusing electrode member having at least three in-line apertures disposed after the first focusing electrode member along the tube axis;

an anode having at least three in-line apertures disposed after the second focusing electrode member along the tube axis;

a phosphor surface disposed after the anode along the tube axis; and a fixed resistor disposed inside the color cathode ray tube, the fixed resistor being coupled between the anode and ground and having a focusing power supply terminal;

wherein the three in-line cathodes emit respective electron beams which pass through respective ones of the in-line apertures of the control electrode, the accelerating electrode, the first focusing electrode member, the second focusing electrode member, and the anode and land on the phosphor surface;

wherein the first focusing electrode member receives a constant focusing voltage from the focusing power supply terminal of the fixed resistor;

wherein the second focusing electrode member receives a dynamic focusing voltage which varies in accordance with a deflection angle of the electron beams;

wherein a quadrupole lens is formed between the first focusing electrode member and the second focusing electrode member by the constant focusing voltage received by the first focusing electrode member and the dynamic focusing voltage received by the second focusing electrode member; and wherein the quadrupole lens converges each of the electron beams in a first direction and diverges each of the electron beams in a second direction perpendicular to the first direction, and has an intensity which varies in accordance with the dynamic focusing voltage, thereby varying in accordance with the deflection angle of the electron beams.

2. A color cathode ray tube according to claim 1, further comprising a variable resistor, wherein the fixed resistor is coupled to ground through the variable resistor.

3. A color cathode ray tube according to claim 1, further comprising a DC power supply, wherein the fixed resistor is coupled to ground through the DC power supply.

4. A color cathode ray tube according to claim 1, further comprising a variable resistor and a DC power supply, wherein the fixed resistor is coupled to ground through the variable resistor and the DC power supply.

5. A color cathode ray tube comprising:

three in-line cathodes;

a control electrode having at least three in-line apertures disposed after the three in-line cathodes along a tube axis of the color cathode ray tube;

a first accelerating electrode having at least three in-line apertures disposed after the control electrode along the tube axis;

a front-stage focusing electrode having at least three in-line apertures disposed after the first accelerating electrode along the tube axis;

a second accelerating electrode having at least three in-line apertures disposed after the front-stage focusing electrode along the tube axis;

a first rear-stage focusing electrode member having at least three in-line apertures disposed after the second accelerating electrode along the tube axis;

a second rear-stage focusing electrode member having at least three in-line apertures disposed after the first rear-stage focusing electrode member along the tube axis;

an anode having at least three in-line apertures disposed after the second rear-stage focusing electrode member along the tube axis;

a phosphor surface disposed after the anode along the tube axis; and a fixed resistor disposed inside the color cathode ray tube, the fixed resistor being coupled between the anode and ground and having a focusing power supply terminal;

wherein the three in-line cathodes emit respective electron beams which pass through respective ones of the in-line apertures of the control electrode, the first accelerating electrode, the front-stage focusing electrode, the second accelerating electrode, the first rear-stage focusing electrode member, the second rear-stage focusing electrode member, and the anode and land on the phosphor surface;

wherein the first accelerating electrode and the second accelerating electrode receive a constant voltage;

wherein the first rear-stage focusing electrode member receives a constant focusing voltage from the focusing power supply terminal of the fixed resistor;

wherein the front-stage focusing electrode and the second rear-stage focusing electrode member receive a dynamic focusing voltage which varies in accordance with a deflection angle of the electron beams;

wherein a quadrupole lens is formed between the first rear-stage focusing electrode member and the second rear-stage focusing electrode member by the constant focusing voltage received by the first rear-stage focusing electrode member and the dynamic focusing voltage received by the second rear-stage focusing electrode member; and wherein the quadrupole lens converges each of the electron beams in a first direction and diverges each of the electron beams in a second direction perpendicular to the first direction, and has an intensity which varies in accordance with the dynamic focusing voltage, thereby varying in accordance with the deflection angle of the electron beams.

6. A color cathode ray tube according to claim 5, further comprising a variable resistor, wherein the fixed resistor is coupled to ground through the variable resistor.

7. A color cathode ray tube according to claim 5, further comprising a DC power supply, wherein the fixed resistor is coupled to ground through the DC power supply.

8. A color cathode ray tube according to claim 5, further comprising a variable resistor and a DC power supply, wherein the fixed resistor is coupled to ground through the variable resistor and the DC power supply.

* * * * *